US007443376B2

(12) United States Patent
Suzuki

(10) Patent No.: US 7,443,376 B2
(45) Date of Patent: Oct. 28, 2008

(54) SCAN ELECTRODE DRIVING CIRCUIT AND DISPLAY APPARATUS

(75) Inventor: Kenji Suzuki, Kanagawa (JP)

(73) Assignee: NEC Electronics Corporation, Tokyo (JP)

( * ) Notice: Subject to any disclaimer, the term of this patent is extended or adjusted under 35 U.S.C. 154(b) by 577 days.

(21) Appl. No.: 10/885,686

(22) Filed: Jul. 8, 2004

(65) Prior Publication Data

US 2005/0012728 A1 Jan. 20, 2005

(30) Foreign Application Priority Data

Jul. 17, 2003 (JP) ..... 2003-276283

(51) Int. Cl.
*G90G 3/36* (2006.01)

(52) U.S. Cl. ..... 345/100; 345/87; 345/204

(58) Field of Classification Search ..... 345/60–72, 345/76–83, 87–100, 204–213; 315/169.1–169.4
See application file for complete search history.

(56) References Cited

U.S. PATENT DOCUMENTS 5,657,040 A * 8/1997 Kanbara ..... 345/98
6,326,943 B1 * 12/2001 Inoue et al. ..... 345/101
6,736,512 B2 * 5/2004 Balogh ..... 353/7
7,002,561 B1 * 2/2006 Dotson ..... 345/204
7,158,127 B1 * 1/2007 Dotson ..... 345/204
2003/0112214 A1 * 6/2003 Smith et al. ..... 345/98

FOREIGN PATENT DOCUMENTS

JP 2002-278494 A 9/2002

* cited by examiner

*Primary Examiner*—Alexander Eisen
*Assistant Examiner*—Cory A Almeida
(74) *Attorney, Agent, or Firm*—Sughrue Mion, PLLC

(57) ABSTRACT

A scan electrode driving circuit has a scanning signal generating circuit, and M (M≧2) output circuits connected to the scanning signal generating circuit. The scanning signal generating circuit generates a first to N-th (N≧2) output signals in order, and outputs them repeatedly to the M output circuits. Also, the scanning signal generating circuit counts the number of repeat times, and outputs a count data signal indicative of the number of repeat times to the M output circuits. When the count data signal indicates a value k (0≦k≦M−1), k-th output circuit of the M output circuits converts the first to N-th output signals to a first to N-th scanning signals, respectively, and outputs them to N scan electrodes of a display panel in order, respectively.

14 Claims, 8 Drawing Sheets

SCAN ELECTRODE DRIVING CIRCUIT AND DISPLAY APPARATUS

BACKGROUND OF THE INVENTION

1. Field of the Invention

The present invention relates to a scan electrode driving circuit and a display apparatus having the scan electrode driving circuit.

2. Description of the Related Art

A display apparatus such as a liquid crystal display apparatus or the like has a display panel and a peripheral unit. The peripheral unit is connected to the display panel and controls the display panel. The display panel has a plurality of scan electrodes, a plurality of data electrodes and a plurality of pixel cells. The plurality of scan electrodes are perpendicular to the plurality of data electrodes, and the plurality of pixel cells are provided at regions where the plurality of scan electrodes cross the plurality of data electrodes. The peripheral unit has a scan electrode driving circuit and a data electrode driving circuit. The scan electrode driving circuit applies a scanning signal to the plurality of scan electrodes in order. A scan electrode to which the scanning signal is applied is a selected scan electrode, and pixel cells connected to the selected scan electrode are selected pixel cells. Also, the data electrode driving circuit applies to the plurality of data electrodes pixel voltages which are associated with image data. Thus, the pixel voltages are supplied to the selected pixel cells and the image data is displayed on the display panel.

The scan electrode driving circuit has shift registers, level shift circuits and output buffers. The shift registers generate scanning signals. Each level shift circuit converts voltage level of the scanning signal from low voltage level to high voltage level. Here, a signal with high voltage level is used in the display panel. Each output buffer supplies the scanning signal with high voltage level to a scan electrode. The circuit scale of the scan electrode driving circuit is dependent on the number of the plurality of scan electrodes in the display panel.

As shown in FIG. 1, for example, such a conventional display apparatus has an LCD (Liquid Crystal Display) panel 1, a data electrode driving circuit 2, a scan electrode driving circuit 3 and a timing controller 4. The LCD panel 1 has data electrodes $X_i$ (i=1, 2 to m, for example, m=640×3), scan electrodes $Y_j$ (j=1, 2 to n, for example, n=512) and pixel cells $\mathbf{10}_{i,j}$. Pixel voltages $D_i$ are applied to the data electrodes $X_i$. Scanning signals $OUT_j$ are applied to the scan electrodes $Y_j$ in order. The pixel cells $\mathbf{10}_{i,j}$ are provided at regions where the data electrodes $X_i$ cross the scan electrodes $Y_j$. Each pixel cell $\mathbf{10}_{i,j}$ has a TFT (Thin Film Transistor) $\mathbf{11}_{i,j}$, liquid crystal cell $\mathbf{12}_{i,j}$ and a common electrode COM. Based on image data VD received from a control unit (not shown), the data electrode driving circuit 2 applies the pixel voltages $D_i$ to the respective data electrodes $X_i$. The scan electrode driving circuit 3 has two driving circuit blocks 31, 32, for example. This scan electrode driving circuit 3 applies the scanning signals $OUT_j$ to the respective scan electrodes $Y_j$ in order. The timing controller 4 outputs a control signal Sf to the data electrode driving circuit 2, and controls the operation of the data electrode driving circuit 2. Also, the timing controller 4 outputs an initiation signal Sg to the scan electrode driving circuit 3, and controls the operation of the scan electrode driving circuit 3.

FIG. 2 is a circuit diagram showing a configuration of the driving circuit block 31 in FIG. 1. As shown in FIG. 2, this driving circuit block 31 has shift registers $\mathbf{41}_0$, $\mathbf{41}_1$, $\mathbf{41}_2$ and $\mathbf{41}_3$, output level shift circuits $\mathbf{42}_0$, $\mathbf{42}_1$, $\mathbf{42}_2$ and $\mathbf{42}_3$, and output buffer circuits $\mathbf{43}_0$, $\mathbf{43}_1$, $\mathbf{43}_2$ and $\mathbf{43}_3$. In response to an initiation signal Sg, the shift register $\mathbf{41}_0$ outputs scanning signals Se1, Se2 to Se64 in order in synchronization with a clock signal (not shown). Also, the shift register $\mathbf{41}_0$ outputs an initiation signal Sg0 together with the scanning signal Se64. In response to the initiation signal Sg0, the shift register $\mathbf{41}_1$ outputs scanning signals Se65, Se66 to Se128 in order in synchronization with the clock signal. Also, the shift register $\mathbf{41}_1$ outputs an initiation signal Sg1 together with the scanning signal Se128. In response to the initiation signal Sg1, the shift register $\mathbf{41}_2$ outputs scanning signals Se129, Se130 to Se192 in order in synchronization with the clock signal. Also, the shift register $\mathbf{41}_2$ outputs an initiation signal Sg2 together with the scanning signal Se192. In response to the initiation signal Sg2, the shift register $\mathbf{41}_3$ outputs scanning signals Se193, Se194 to Se256 in order in synchronization with the clock signal. Also, the shift register $\mathbf{41}_3$ outputs an initiation signal Sg3 together with the scanning signal Se256.

The output level shift circuits $\mathbf{42}_0$, $\mathbf{42}_1$, $\mathbf{42}_2$ and $\mathbf{42}_3$ convert voltage level of the scanning signals Se1 to Se64, Se65 to Se128, Se129 to Se192 and Se193 to Se256 from the low voltage level to the high voltage level, respectively. The output buffer circuits $\mathbf{43}_0$, $\mathbf{43}_1$, $\mathbf{43}_2$ and $\mathbf{43}_3$ output the converted scanning signals Se1 to Se64, Se65 to Se128, Se129 to Se192 and Se193 to Se256 as scanning signals $OUT_1$ to $OUT_{64}$, $OUT_{65}$ to $OUT_{128}$, $OUT_{129}$ to $OUT_{192}$ and $OUT_{193}$ to $OUT_{256}$, respectively. The outputted scanning signals $OUT_1$ to $OUT_{256}$ with high voltage level are applied to the scan electrodes $Y_1$ to $Y_{256}$, respectively.

The driving circuit block 32 is configured similarly to the driving circuit block 31, and cascade-connected to the driving circuit block 31. In response to the initiation signal Sg3 outputted from the driving circuit block 31, the driving circuit block 32 applies scanning signals $OUT_{257}$ to $OUT_{512}$ with high voltage to the scan electrodes $Y_{257}$ to $Y_{512}$ in synchronization with the clock signal, respectively.

In this conventional LCD apparatus, the scan electrode driving circuit 3 applies the scanning signals $OUT_j$ to the scan electrodes $Y_j$ (j=1~512) in order, respectively. Thus the pixel cells $\mathbf{10}_i$ connected to the selected electrode $Y_j$ are selected. Also, the data electrode driving circuit 2 applies the pixel voltages $D_i$ to the data electrodes $X_i$. Thus, the pixel voltages $D_i$ are supplied to the selected pixel cells $\mathbf{10}_i$, and hence the image data VD is displayed on the LCD panel 1.

However, there are the following problems with this conventional LCD apparatus shown in FIG. 1.

That is to say, it is necessary to prepare a lot of shift registers, output level shift circuits and output buffer circuits in the scan electrode driving circuit 3 according to the number of the scan electrodes $Y_j$ (j=1 to 512), as shown in FIG. 2. Thus the circuit scale of the scan electrode driving circuit 3 becomes large. In particular, when this scan electrode driving circuit 3 is formed in a rectangular chip, it is difficult to reduce the length of the short side of the rectangular chip. The peripheral unit surrounding the LCD panel 1, in which the scan electrode driving circuit 3 is provided, is associated with a marginal area of this LCD apparatus. Therefore, it is difficult to make the marginal area of the LCD apparatus narrower. Moreover, the larger the circuit scale of the scan electrode driving circuit 3 becomes, the more cost are required and the more complex it becomes to manufacture the LCD apparatus.

Also, Japanese Laid Open Patent Application (JP-P2002-278494A) discloses another LCD apparatus. FIG. 3 schematically shows a configuration of a scan electrode driving circuit of the LCD apparatus in the patent document.

In the scan electrode driving circuit, outputs from shift registers SR61~SR116 can be supplied to the corresponding scan electrodes in two ways. That is, two switch circuits are connected to each of the shift registers SR61~SR116. More specifically, switching circuits SW1~SW56 and switching circuits SW116~SW61 are connected to the shift registers SR116~SR61 through decoders DE116~DE61. A control signal SEL_UP activates the switching circuits SW1~SW56. A control signal SEL_LO activates the switching circuits SW61~SW116. At first, a driving signal is shifted from the shift register SR116 to the shift register SR61 in order. After that, the driving signal is shifted from the shift register SR61 to SR57, SR58, SR59, SR60. Then, a control signal SEL_SFT is inputted, which reverses the direction of the signal shifting in the shift registers SR61~SR116. Thus, the driving signal is shifted from the shift register SR61 to the shift register SR116 in order. When a shift register SR receives the driving signal, the corresponding decoder DE generates a scanning signal, and outputs the scanning signal to the corresponding scan electrode through the activated switching circuit SW. According to this scan electrode driving circuit, the shift registers SR61~SR116 and the decoders DE61~DE116 are shared. Therefore, the number of circuits is reduced.

This scan electrode driving circuit is formed in a rectangular chip. Output pads connected to the switching circuits SW1~SW56 are formed along one long side of the rectangular chip. On the other hand, output pads connected to the switching circuits SW61~SW116 are formed along the other long side of the rectangular chip. Therefore, the configuration of wirings connecting the switching circuits SW and the output pads becomes complicated. Moreover, regions occupied by the wirings become large. Thus, similar to the above-mentioned conventional LCD apparatus, it is also difficult to make the peripheral unit smaller.

It is required to make the peripheral unit smaller and hence to make the marginal area narrower.

SUMMARY OF THE INVENTION

Therefore, an object of the present invention to provide a scan electrode driving circuit with smaller size.

Another object of the present invention is to provide a display apparatus having a smaller peripheral unit and a narrower marginal area.

Still another object of the present invention is to provide a scan electrode driving circuit and a display apparatus which are manufactured with low cost and low complexity.

In an aspect of the present invention, a scan electrode driving circuit, which supplies a scanning signal to each of a plurality of scan electrodes of a display panel, includes a plurality of driving circuit blocks connected one after another. Each of the plurality of driving circuit blocks has a scanning signal generating circuit and M (M is an integer larger than 1) output circuits connected to the scanning signal generating circuit. The scanning signal generating circuit generates a first to N-th (N is an integer larger than 1) output signals in order, and outputs the first to N-th output signals repeatedly to each of the M output circuits. Also, the scanning signal generating circuit counts the number of repeat times, and outputs a count data signal indicative of the number of repeat times to each of the M output circuits. When the count data signal indicates a value k (k is an integer in a range from 0 to M−1), k-th output circuit of the M output circuits converts the first to N-th output signals to a first to N-th scanning signals, respectively. Then, the k-th output circuit outputs the first to N-th scanning signals to N scan electrodes of the plurality of scan electrodes in order, respectively.

The scanning signal generating circuit has a shift register and a counter connected to the shift register. The shift register includes a first to N-th flip-flop circuits which are connected one after another. Here, an output of the N-th flip-flop circuit is connected to the counter and an input of the first flip-flop circuit. An initiation signal inputted to the first flip-flop circuit is shifted from the first flip-flop circuit to the N-th flip-flop circuit in synchronization with a clock signal. In response to the initiation signal, the first to N-th flip-flop circuits output the first to N-th output signals to each output circuit, respectively. The counter counts the number of the N-th output signals outputted from the N-th flip-flop circuit as the number of repeat times, and outputs the count data signal to each output circuit.

Each of the M output circuits has a decoder receiving the count data signal and a first to N-th output buffers. The first to N-th output buffers are connected to the first to N-th flip-flop circuits, respectively. When the count data signal indicates the value k, the decoder of the k-th output circuit generates an activation signal which activates the first to N-th output buffers If activated, the first to N-th output buffers convert the first to N-th output signals to the first to N-th scanning signals, respectively. Then, the first to N-th output buffers output the first to N-th scanning signals to the N scan electrodes, respectively.

The scanning signal generating circuit further has a logic circuit connected to the shift register and the counter. The counter outputs a carry signal to the logic circuit when the number of repeat times becomes M−1. When receiving the carry signal from the counter and the N-th output signal from the N-th flip-flop circuit, the logic circuit prohibits transmission of the initiation signal from the N-th flip-flop circuit to the first flip-flop circuit. Also, the logic circuit outputs another initiation signal to another of the plurality of driving circuit blocks.

The scanning signal generating circuit can further has a first level shift circuit and a second level shift circuit. The first level shift circuit is connected to the shift register and the M output circuits. This first level shift circuit receives the first to N-th output signals from the shift register, and outputs the first to N-th output signals to the M output circuits after converting voltage level from low level to high level. The second level shift circuit is connected to the counter and the M output circuits. This second level shift circuit receives the count data signal from the counter, and outputs the count data signal after converting voltage level from low level to high level.

The scanning signal generating circuit mentioned above is formed in a middle of a rectangular chip. Also, the M output circuits mentioned above are formed along a long side of the rectangular chip.

As mentioned above, according to the present invention, the output signals are generated repeatedly by one shift register. Based on the number of repeat times, the output signals are repeatedly used as the scanning signals. Thus, the one shift register and the one level shift circuit are shared by the M output circuits. Therefore, the size of the scan electrode driving circuit can be greatly reduced. In other words, it is possible to make a peripheral unit smaller and hence to make the marginal area of a display apparatus narrower. Moreover, the configuration of the scan electrode driving circuit becomes less complex than that of the conventional one. Therefore, it is possible to reduce the cost and complexity for manufacturing this scan electrode driving circuit.

In another aspect of the present invention, the first level shift circuit is connected to the shift register. This first level shift circuit receives the initiation signal, and outputs the initiation signal to the first flip-flop circuit after converting voltage level from low level to high level. The second level shift circuit is connected to the logic circuit. This second level shift circuit receives the other initiation signal from the logic circuit, and outputs the other initiation signal to the other driving circuit block after converting voltage level from high level to low level.

In still another aspect of the present invention, a display apparatus includes a display panel and the above-mentioned scan electrode driving circuit. The display panel has a plurality of scan electrodes. For example, the display panel is a liquid crystal display panel. The scan electrode driving circuit is configured for supplying scanning signals to the plurality of scan electrodes.

DESCRIPTION OF THE PREFERRED EMBODIMENTS

Embodiments of the present invention will be described below with reference to the attached drawings.

First Embodiment

Figure 1:
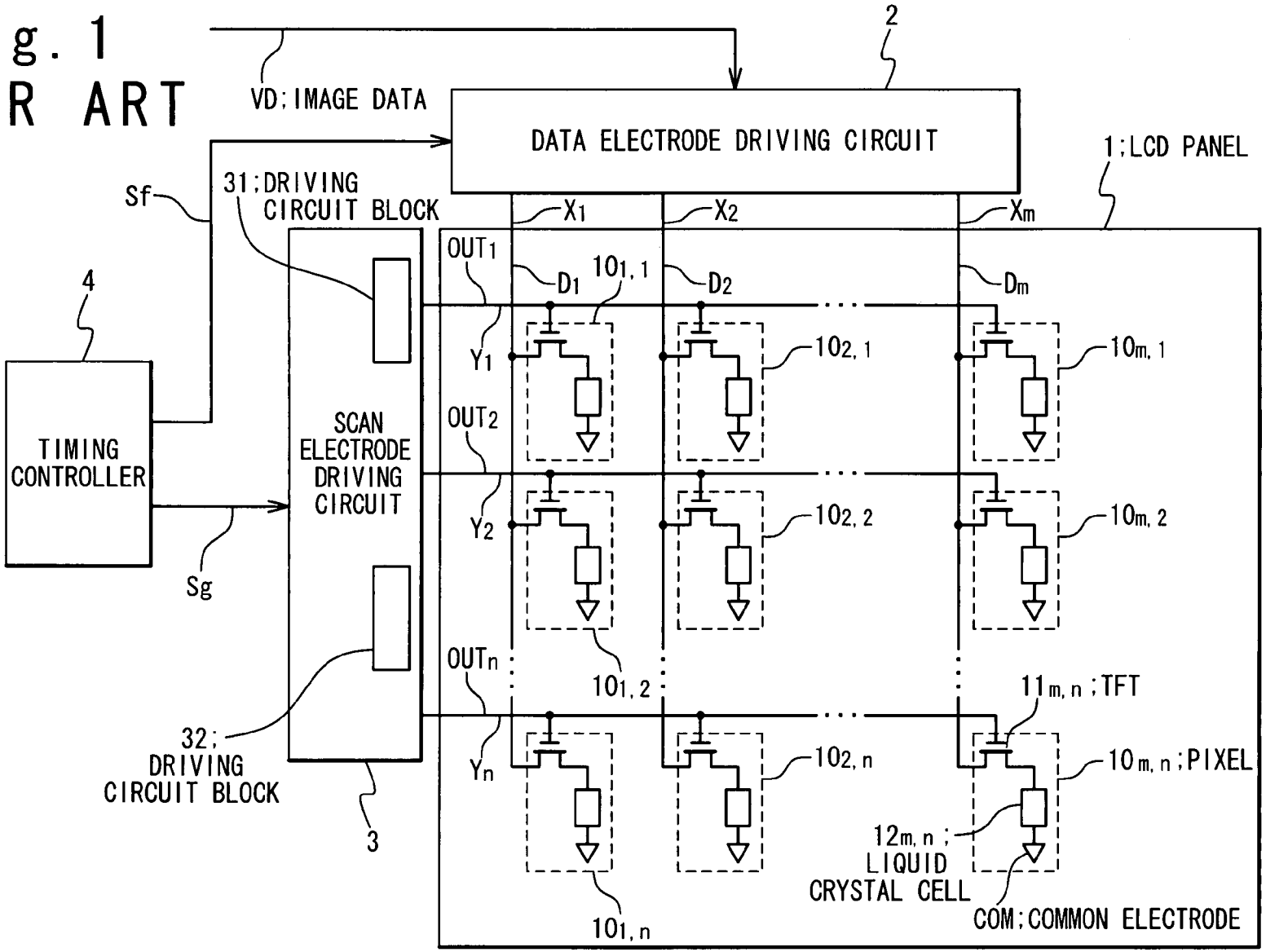
Fig. 1 PRIOR ART
FIG. 1 is a block diagram showing a configuration of a conventional display apparatus.
Figure 2:
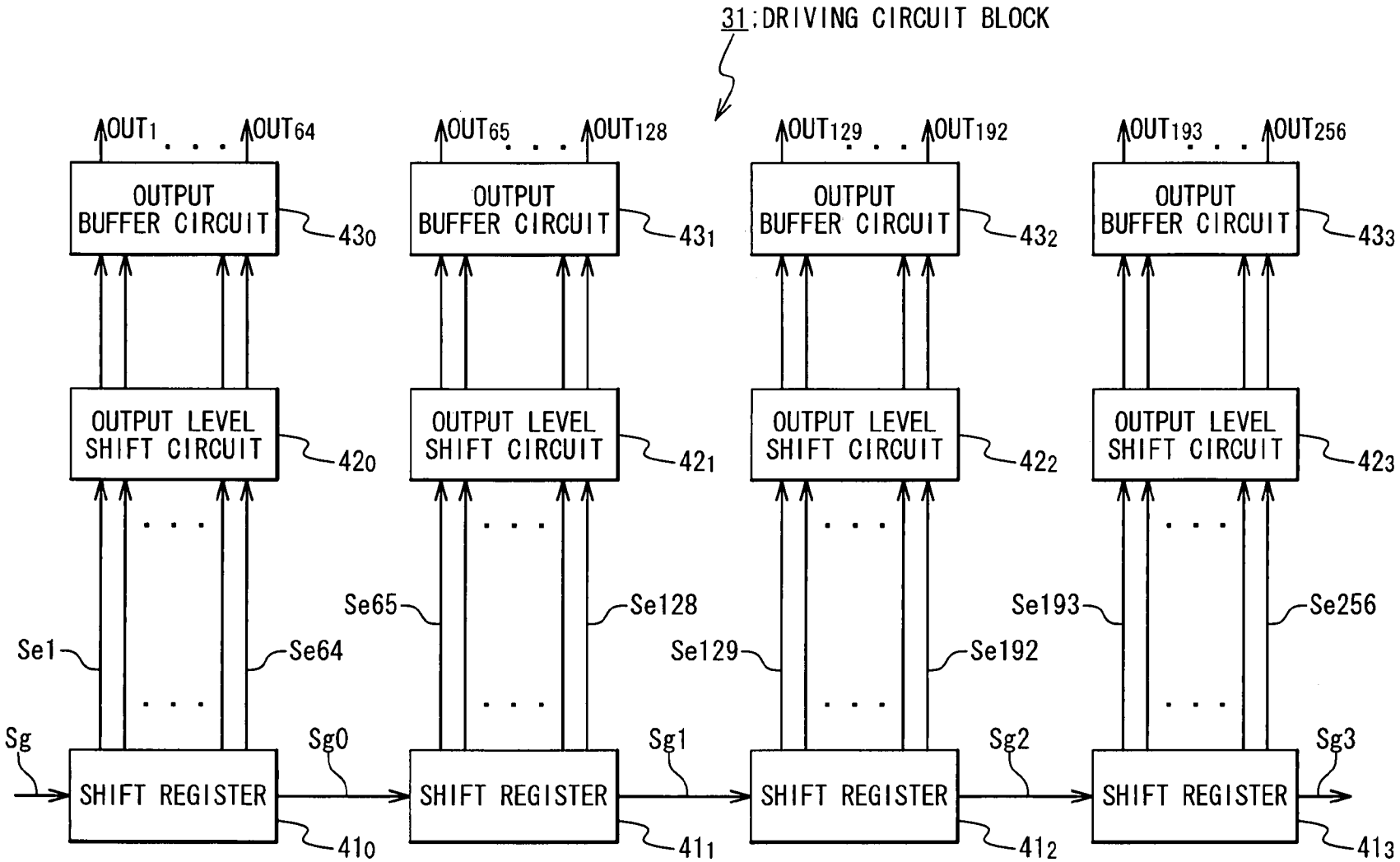
Fig. 2 PRIOR ART
FIG. 2 is a circuit diagram showing a configuration of a driving circuit block of the conventional display apparatus.
Figure 3:
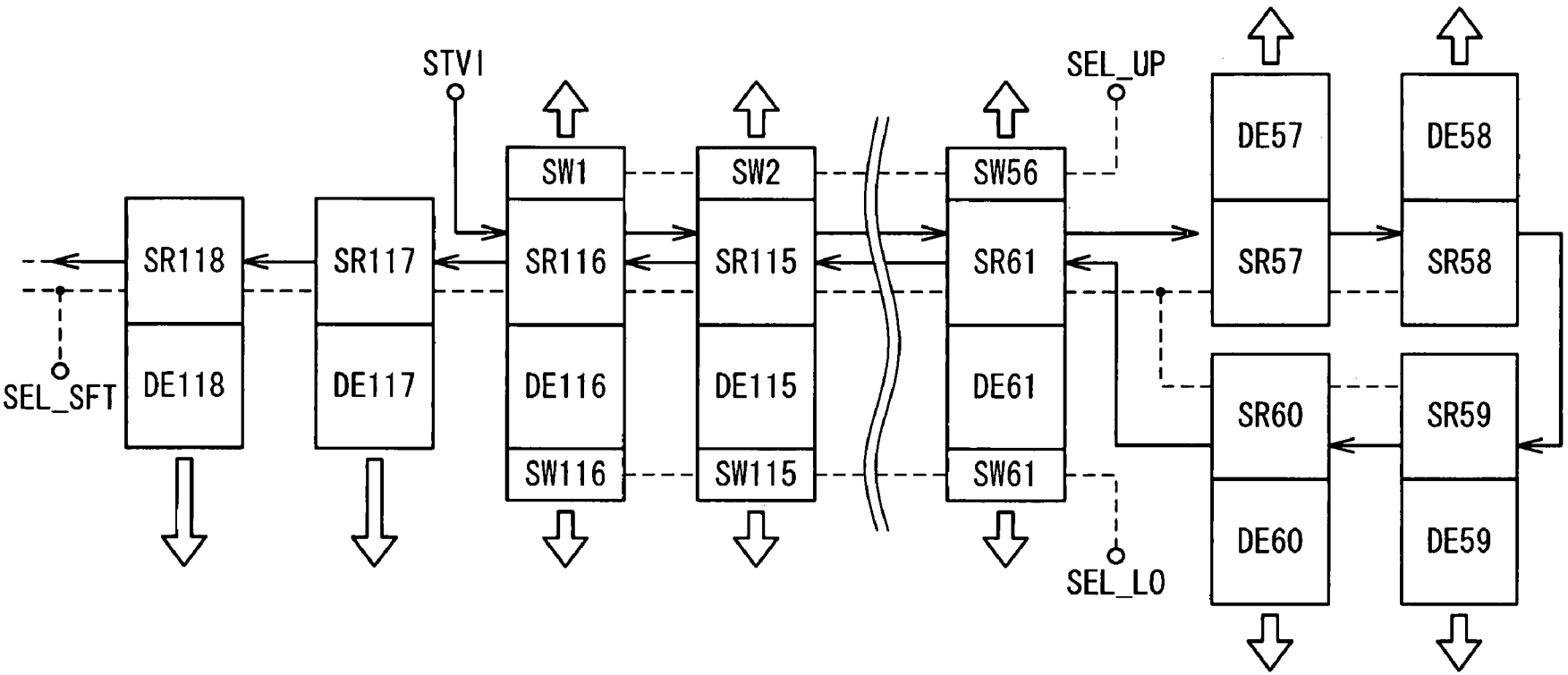
Fig. 3 PRIOR ART
FIG. 3 is a schematic view showing a configuration of a scan electrode driving circuit of another conventional display apparatus.
Figure 4:
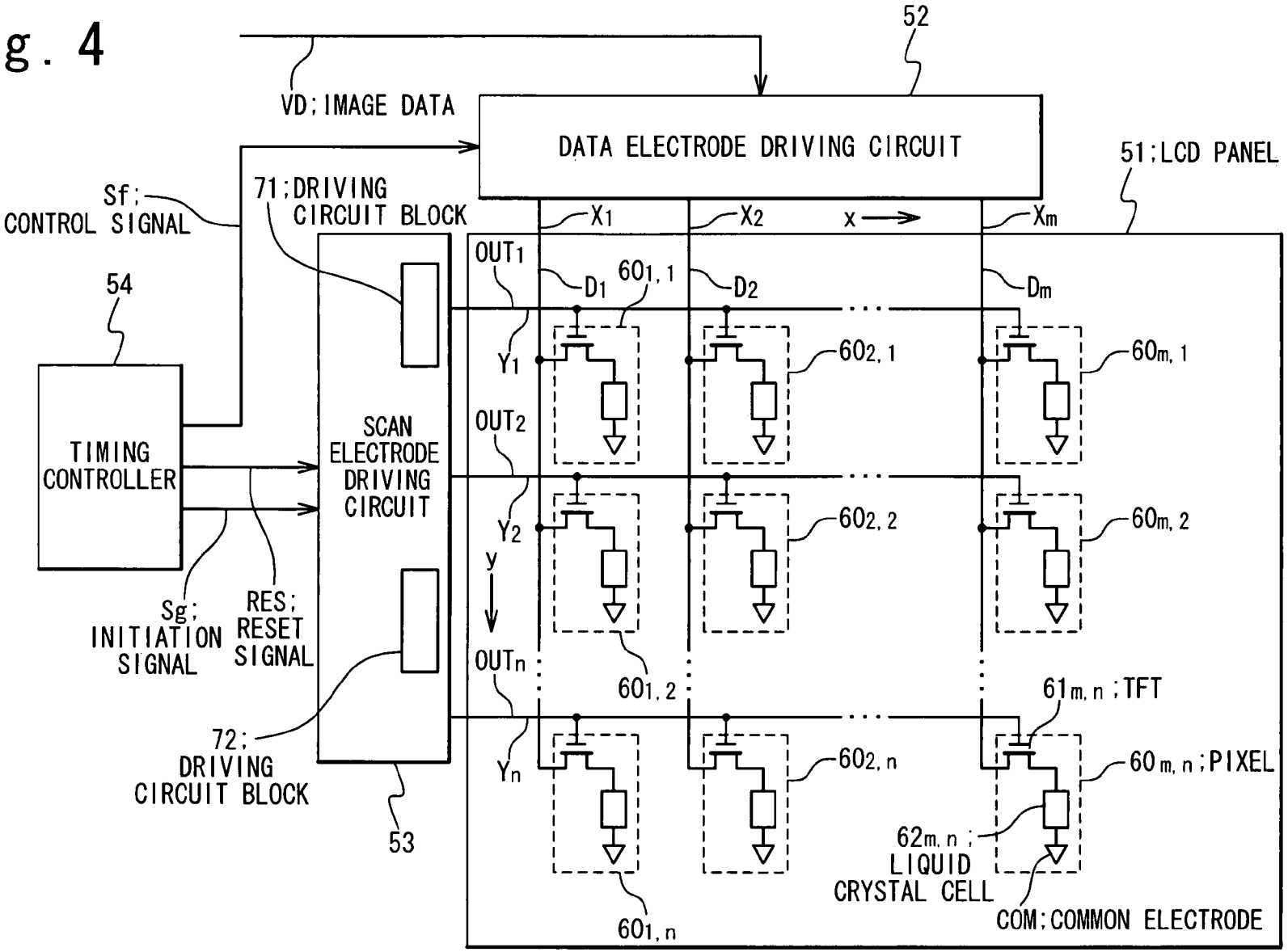
FIG. 4 is a block diagram showing a configuration of a display apparatus according to a first embodiment of the present invention.

FIG. 4 is a block diagram showing a configuration of a display apparatus according to a first embodiment of the present invention. Here, an LCD (Liquid Crystal Display) apparatus is shown as an example of the display apparatus. The LCD apparatus includes an LCD panel 51 as a display panel and a peripheral unit. This peripheral unit includes a set of circuits for controlling the LCD panel 51. Also, this peripheral unit is located around the LCD panel 51, and is associated with a "marginal area" of the LCD apparatus.

The LCD panel 51 has a plurality of data electrodes $X_i$ (i=1, 2 to m, for example, m=640×3) a plurality of scan electrodes $Y_j$ (j=1, 2 to n, for example, n=512) and a plurality of pixel cells $\mathbf{60}_{i,j}$. The plurality of data electrodes $X_i$ are formed along an y-direction and arranged in an x-direction. The plurality of scan electrodes $Y_j$ are formed along the x-direction and arranged in the y-direction. Thus, the plurality of data electrodes $X_i$ are perpendicular to the plurality of scan electrodes $Y_j$. The plurality of pixel cells $\mathbf{60}_{i,j}$ are provided at regions where the plurality of data electrodes $X_i$ cross the plurality of scan electrodes $Y_j$. Each of the plurality of pixel cells $\mathbf{60}_{i,j}$ has a TFT (Thin Film Transistor) $\mathbf{61}_{i,j}$, a liquid crystal cell $\mathbf{62}_{i,j}$ and a common electrode COM. The gate electrode of each TFT $\mathbf{61}_{i,j}$ is connected to a corresponding one of the plurality of scan electrodes $Y_j$, and the drain of each TFT $\mathbf{61}_{i,j}$ is connected to a corresponding one of the plurality of data electrodes $X_i$.

The peripheral unit has a data electrode driving circuit 52, a scan electrode driving circuit 53 and a timing controller 54, as shown in FIG. 4. The data electrode driving circuit 52 is connected to the plurality of data electrodes $X_i$, and supplies pixel voltages $D_i$ to the plurality of data electrodes $X_i$. The scan electrode driving circuit 53 is connected to the plurality of scan electrodes $Y_j$, and supplies scanning signals $OUT_j$ to the plurality of scan electrodes $Y_j$ in order. This scan electrode driving circuit 3 has a plurality of driving circuit blocks which are connected one after another. In FIG. 4, for example, the scan electrode driving circuit 3 includes two driving circuit blocks 71, 72. The timing controller 54 outputs a control signal Sf to the data electrode driving circuit 52, and controls the operation of the data electrode driving circuit 52. Also, the timing controller 54 outputs an initiation signal Sg and a reset signal RES to the scan electrode driving circuit 53, and controls the operation of the scan electrode driving circuit 53.

The scan electrode driving circuit 53 supplies the scanning signals $OUT_j$ to the plurality of scan electrodes $Y_j$ in order, respectively. A scan electrode $Y_j$ to which the scanning signal $OUT_j$ is supplied is a selected scan electrode, and pixel cells $\mathbf{60}_{i,j}$ connected to the selected scan electrode are selected pixel cells. The TFTs $\mathbf{61}_{i,j}$ of the selected pixels $\mathbf{60}_{i,j}$ are turned on when the scanning signal $OUT_j$ is applied to the selected scan electrode $Y_j$. Also, image data VD to be displayed on the LCD panel 51 are inputted into the data electrode driving circuit 52. Based on the image data VD, the data electrode driving circuit 52 applies pixel voltages $D_i$ to the plurality of data electrodes $X_i$. Thus, the pixel voltages $D_i$ are applied to the liquid crystal cells $\mathbf{62}_{i,j}$ of the selected pixel cells $\mathbf{60}_{i,j}$, and the image data VD are displayed on the LCD panel 51.

Figure 5:
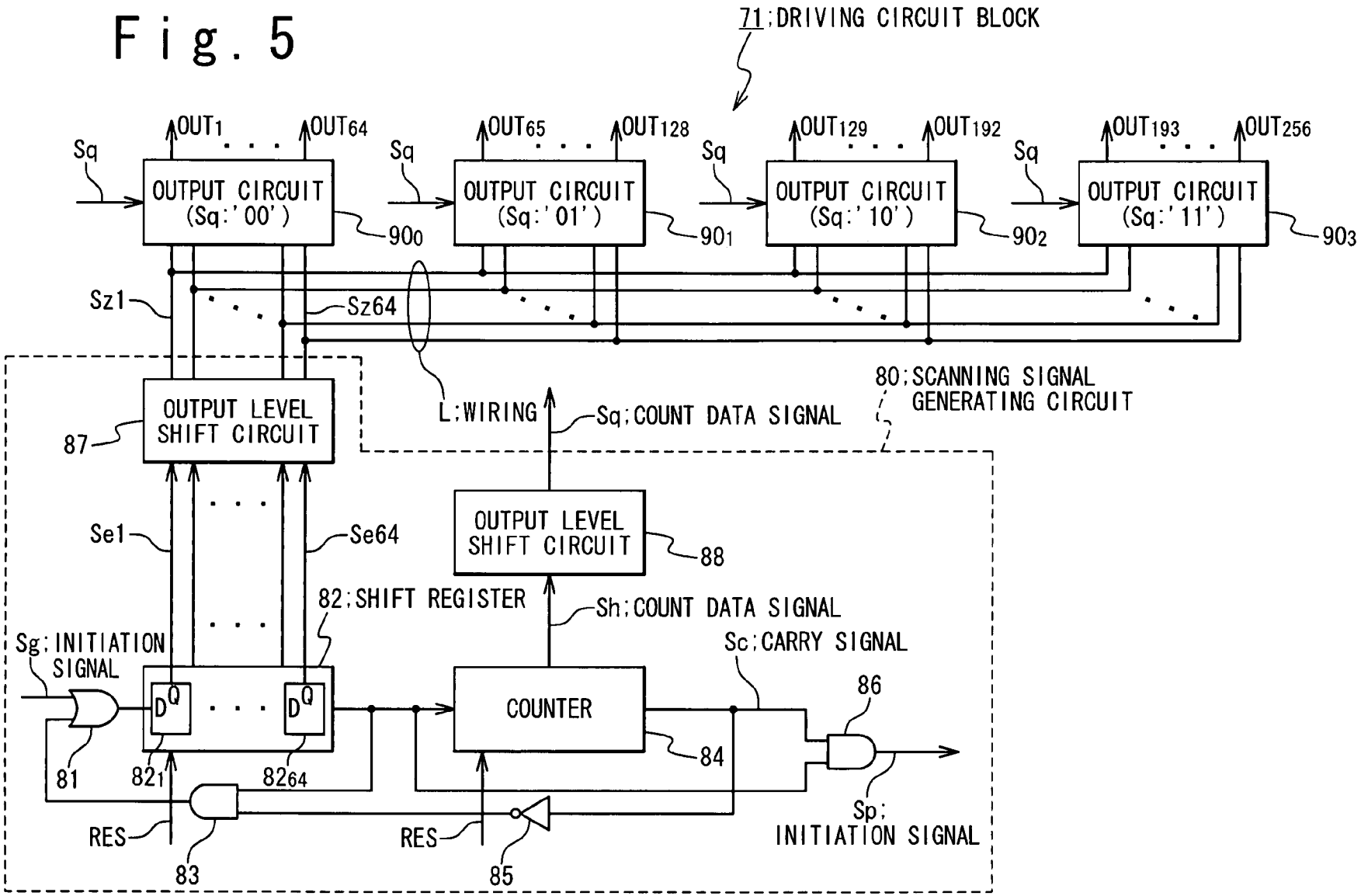
FIG. 5 is a circuit diagram showing a configuration of a driving circuit block of the display apparatus according to the first embodiment of the present invention.

FIG. 5 is a circuit diagram showing a configuration of the driving circuit block 71 of the scan electrode driving circuit 53 according to the present embodiment.

The driving circuit block 71 has a scanning signal generating circuit 80 and M (M is an integer larger than 1) output circuits $\mathbf{90}_0$~$\mathbf{90}_{M-1}$. In the present embodiment, the integer M is set to 4, for example. The scanning signal generating circuit 80 is connected to each of the output circuits $\mathbf{90}_0$, $\mathbf{90}_1$, $\mathbf{90}_2$ and $\mathbf{90}_3$ through a wiring L. The scanning signal generating circuit 80 receives the initiation signal Sg from the timing controller 54. In response to the initiation signal Sg, the scanning signal generating circuit 80 begins to generate N output signals Sz (N is an integer larger than 1) in order. In the present embodiment, for example, the integer N is set to 64, i.e., the scanning signal generating circuit 80 generates a first output signal Sz1 to a N-th output signal SZ64 in order. Then, the scanning signal generating circuit 80 outputs the first to N-th output signals Sz1~Sz64 "repeatedly" to each of the output circuits $\mathbf{90}_0$~$\mathbf{90}_3$. Moreover, the scanning signal generating circuit 80 counts the number of repeat times, and generates a count data signal Sq indicative of the number of repeat times. Then, the scanning signal generating circuit 80 outputs the count data signal Sq to each of the output circuits $\mathbf{90}_0$~$\mathbf{90}_3$.

Each of the output circuits $\mathbf{90}_0$~$\mathbf{90}_3$ receives the output signals Sz1~Sz64 and the count data signal Sq from the scanning signal generating circuit 80. When the number of repeat times is 0, the 0-th output circuit $\mathbf{90}_0$ converts the output signals Sz1~Sz64 to the scanning signals $OUT_1$~$OUT_{64}$, respectively. When the number of repeat times is 1, the first output circuit $\mathbf{90}_1$ converts the output signals Sz1~Sz64 to the scanning signals $OUT_{65}$~$OUT_{128}$, respectively. When the number of repeat times is 2, the second output circuit $90_2$ converts the output signals Sz1~Sz64 to the scanning signals $OUT_{129}$~$OUT_{192}$, respectively. When the number of repeat times is 3, the third output circuit $90_3$ converts the output signals Sz1~Sz64 to the scanning signals $OUT_{193}$~$OUT_{256}$, respectively. Thus, when the count data signal Sq indicates a value k (k is an integer in a range from 0 to M−1), the k-th output circuit $90_k$ converts the received output signals Sz to the N scanning signals OUT, respectively. Then, the k-th output circuit $90_k$ outputs the N scanning signals OUT to the corresponding N scan electrodes Y in order, respectively.

More specifically, the scanning signal generating circuit 80 includes an OR circuit 81, a shift register 82, an AND circuit 83, a counter 84, an inverter 85, an AND circuit 86 and output level shift circuits 87, 88, as shown in FIG. 5.

The shift register 82 includes N flip-flop circuits; a first to N-th flip-flop circuits $82_1$~$82_{64}$. These first to N-th flip-flop circuits $82_1$~$82_{64}$ are connected one after another. Moreover, an output of the N-th flip-flop circuit $82_{64}$ is connected to an input of the first flip-flop circuit $82_1$. The initiation signal Sg outputted from the timing controller 54 is inputted into the first flip-flop circuit $82_1$ through the OR circuit 81. Then, the initiation signal Sg is shifted from the first flip-flop circuit $82_1$ to the N-th flip-flop circuit $82_{64}$ in synchronization with a clock signal CLK (not shown). In response to the shifted initiation signal Sg, the first to N-th flip-flop circuits $82_1$~$82_{64}$ output a first to N-th output signals Se1~Se64 to the output level shift circuit 87 in order. Also, the output signal Se64 (the initiation signal Sg) outputted from the N-th flip-flop circuit $82_{64}$ is supplied to the first flip-flop circuit $82_1$ through the AND circuit 83 and the OR circuit 81 as shown in FIG. 5. Thus, the shift register 82 outputs the first to N-th output signals Se1~Se64 "repeatedly" to the output level shift circuit 87 in order.

The counter 84 is connected to the shift register 82. The N-th output signal Se64 outputted from the N-th flip-flop circuit $82_{64}$ is inputted to this counter 84. Then, the counter 84 counts the number of the inputted N-th output signals Se64 as the number of repeat times. Also, the counter 84 outputs a count data signal Sh which indicates the number of repeat times to the output level shift circuit 88.

The output level shift circuit 87 is connected to the shift register 82, and receives the first to N-th output signals Se1~Se64 from the shift register 82 in order. The output level shift circuit 87 converts voltage level of respective output signals Se1~Se64 from low level to high level. Thus, the first to N-th output signals Sz1~Sz64 with high voltage level are generated. Such a signal with high voltage level is used in the LCD panel 51. Then, the output level shift circuit 87 outputs the first to N-th output signals Sz1~Sz64 to each of the output circuits $90_0$~$90_3$.

The output level shift circuit 88 is connected to the counter 84, and receives the count data signal Sh from the counter 84. The output level shift circuit 88 converts voltage level of the count data signal Sh from low level to high level. Thus, the count data signal Sq with high voltage level is generated. The output level shift circuit 88 outputs the count data signal Sq to each of the output circuits $90_0$~$90_3$. This count data signal Sq is, for example, a 2-bit data indicating "00", "01", "10" and "11".

When the number of repeat times becomes M−1, i.e, when the number of repeat times becomes 3 in this case, the counter 84 generates a carry signal Sc and outputs it to a logic circuit. Here, the logic circuit includes the OR circuit 81, the AND circuit 83, the inverter 85 and the AND circuit 86. When the AND circuit 86 receives the carry signal Sc from the counter 84 and the N-th output signal Se64 from the N-th flip-flop circuit $82_{64}$, the AND circuit 86 outputs a signal as another initiation signal Sp to another of the plurality of driving circuit blocks. In this case, the initiation signal Sp is outputted to a shift register of the driving circuit block 72 connected to the current driving circuit block 71. Also, the carry signal Sc outputted from the counter 84 is inputted to the AND circuit 83 through the inverter 85, which prohibits the transmission of the initiation signal Sg from the N-th flip-flop circuit $82_{64}$ to the first flip-flop circuit $82_1$.

Each of the output circuits $90_0$~$90_3$ has N output buffers, which are connected to the first to N-th flip-flop circuits $82_1$~$82_{64}$ through the output level shift circuit 87, respectively. Each of the output circuits $90_0$~$90_3$ receives the output signals Sz1~Sz64 and the count data signal Sq from the scanning signal generating circuit 80. When the count data signal Sq indicates a value k (k is an integer in a range from 0 to M−1), the k-th output circuit $90_k$ is selected and the M output buffers are activated. The activated output circuit $90_k$ converts the received output signals Sz to the N scanning signals OUT, respectively. Then, the activated output circuit $90_k$ applies the N scanning signals OUT to the corresponding N scan electrodes Y in order, respectively. Here, outputs of the other output circuits are set to the ground-level by a switching circuit (not shown).

Figure 6:
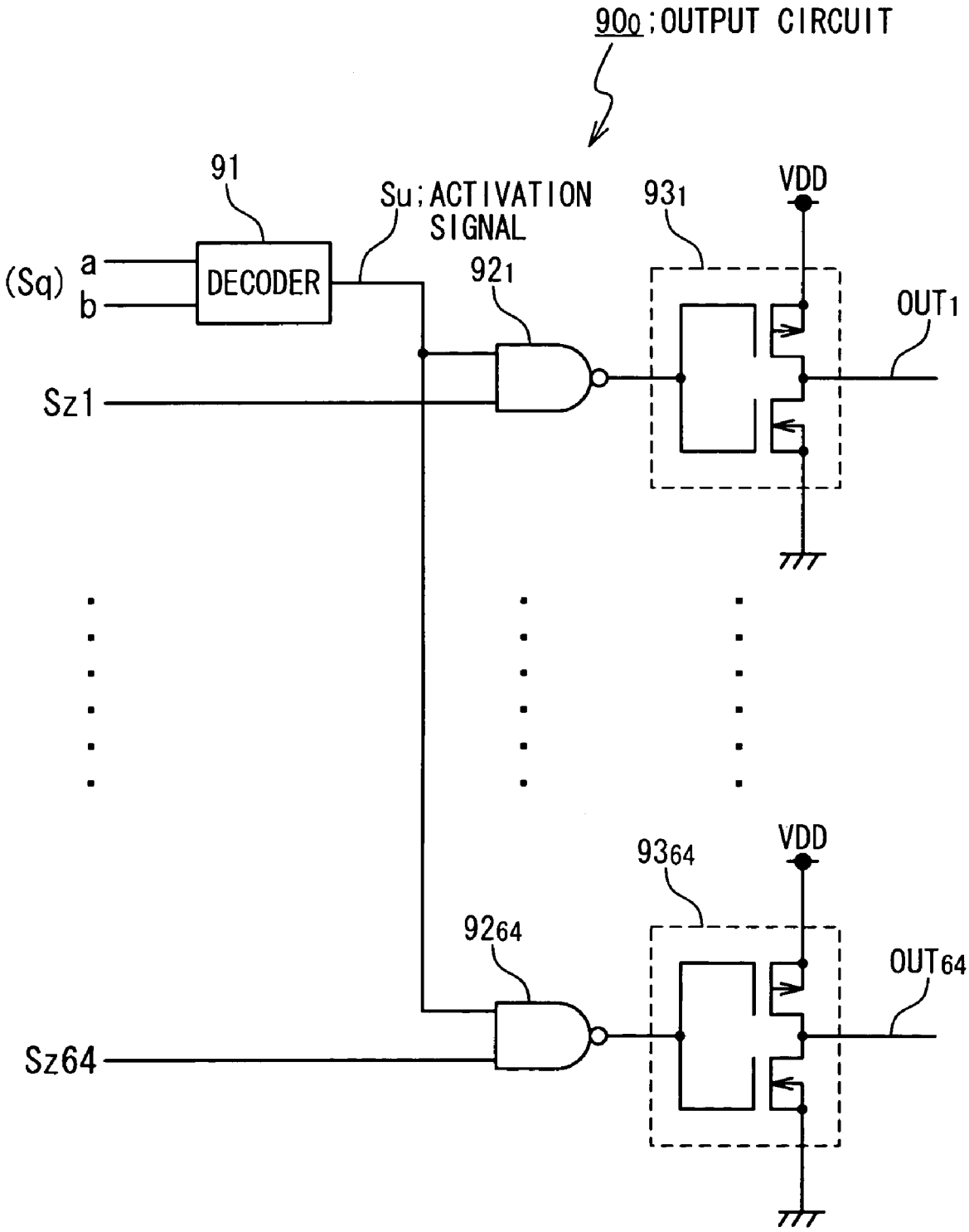
FIG. 6 is a circuit diagram showing a configuration of an output circuit in the driving circuit block according to the first embodiment of the present invention.

FIG. 6 is a circuit diagram showing one example of a configuration of the output circuit 90 in the driving circuit block according to the first embodiment of the present invention.

Each output circuit 90 has a decoder 91, N NAND circuits $92_1$~$92_{64}$ and N CMOS inverters $93_1$~$93_{64}$. The N NAND circuits $92_1$~$92_{64}$ are connected to the first to N-th flip-flop circuits through the output level shift circuit 87, respectively, and are also connected to the decoder 91. The first to N-th CMOS inverters $93_1$~$93_{64}$ are connected to the first to N-th NAND circuits $92_1$~$92_{64}$, respectively. The decoder 91 is connected to the counter 84 through the output level shift circuit 88, and receives the count data signal Sq. Based on the value k indicated by the received count data signal Sq, this decoder 91 outputs a high level activation signal Su to the N NAND circuits $92_1$~$92_{64}$. The count data signal Sq is, for example, a 2-bit data represented by [ba] as shown in FIG. 6.

The decoder 91 of the output circuit $90_0$ outputs the high level activation signal Su when the count data signal Sq indicates the value "00". For example, the decoder 91 of the output circuit $90_0$ is a NOR circuit. When receiving the activation signal Su, the NAND circuits $92_1$~$92_{64}$ inverts the first to N-th output signals Sz1~Sz64 received from the output level shift circuit 87, and outputs the inverted output signals to the first to N-th CMOS inverters $93_1$~$93_{64}$, respectively. The first to N-th CMOS inverters $93_1$~$93_{64}$ inverts the received signals again, and outputs the inverted signals as the first to N-th scanning signals $OUT_1$~$OUT_{64}$, respectively. The decoder 91 of the output circuit $90_1$ outputs the high level activation signal Su when the count data signal Sq indicates the value "01". At this time, the first to N-th CMOS inverters $93_1$~$93_{64}$ in the output circuit $90_1$ outputs the inverted signals as the first to N-th scanning signals $OUT_{65}$~$OUT_{128}$, respectively. The decoder 91 of the output circuit $90_2$ outputs the high level activation signal Su when the count data signal Sq indicates the value "10". At this time, the first to N-th CMOS inverters $93_1$~$93_{64}$ in the output circuit $90_2$ outputs the inverted signals as the first to N-th scanning signals $OUT_{129}$~$OUT_{192}$, respectively. The decoder 91 of the output circuit $90_3$ outputs the high level activation signal Su when the count data signal Sq indicates the value "11". At this time, the first to N-th CMOS inverters $93_1$~$93_{64}$ in the output circuit $90_3$ outputs the inverted signals as the first to N-th scanning signals $OUT_{193}$~$OUT_{256}$, respectively.

Figure 7:
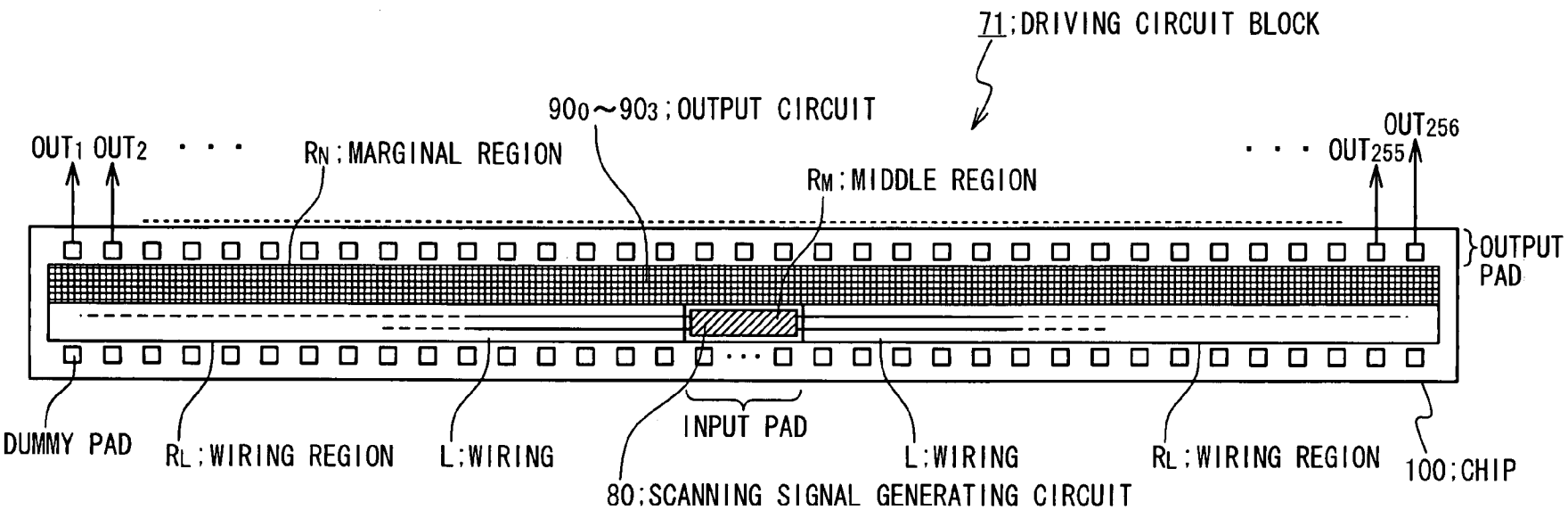
FIG. 7 is a schematic view showing a layout of the driving circuit block of the display apparatus according to the first embodiment of the present invention.

FIG. 7 is a schematic view showing a layout of the driving circuit block 71 according to the present invention. The driving circuit block 71 is formed on a rectangular chip 100. This rectangular chip 100 has a middle region $R_M$ in the middle of the chip 100, a marginal region $R_N$ along a long side of the chip 100 and wiring regions $R_L$ adjacent to the middle region $R_M$ and the marginal region $R_N$, as shown in FIG. 7. According to the present invention, the scanning signal generating circuit 80 is formed in the middle region $R_M$. The M output circuits $90_0$~$90_3$ are formed in the marginal region $R_N$. Also, output pads for outputting the scanning signals $OUT_1$ to $OUT_{256}$ are formed at the end of the marginal region $R_N$. Input pads for receiving the initiation signals Sg, Sp and dummy pads are formed along the other long side of the rectangular chip. The wirings L connecting the scanning signal generating circuit 80 and the output circuits $90_0$~$90_3$ are formed in the wiring regions $R_L$.

The driving circuit block 72 is configured similarly to the driving circuit block 71 and connected to the driving circuit block 71. The driving circuit block 72 receives the initiation signal Sp from the driving circuit block 71. In response to the initiation signal Sp, the driving circuit block 72 applies the scanning signals $OUT_{257}$~$OUT_{512}$ of high voltage level to the scan electrodes $Y_{257}$~$Y_{512}$ in order, respectively, in synchronization with the clock signal CLK.

Next, operations of the scan electrode driving circuit 53 according to the present embodiment will be explained below.

In this scan electrode driving circuit 53, the shift register 82 and the counter 84 are reset by the reset signal RES outputted from the timing controller 54. Then, the timing controller 54 outputs the initiation signal Sg to the scanning signal generating circuit 80, and the shift register 82 receives the initiation signal Sg through the OR circuit 81. Then, the shift register 82 outputs the first to N-th output signals Se1~Se64 in order in synchronization with the clock signal CLK. The output signal Se64 outputted from the N-th flip-flop circuit $82_{64}$ is inputted to the first flip-flop circuit $82_1$ through the AND circuit 83 and the OR circuit 81. Thus, the output signals Se1~Se64 are repeatedly generated. The voltage level of the output signals Se1~Se64 are converted from the low voltage level (for example, 5V) to the high voltage level (for example, 30V) by the output level shift circuit 87. Thus, the output signals Sz1~Sz64 with high voltage level are repeatedly generated.

Also, the number of repeat times is counted by the counter 84. This counter 84 outputs the count data signal Sh indicative of the number of repeat times. This count data signal Sh is converted into the count data signal Sq with high voltage level by the output level shift circuit 88. This count data signal Sq is inputted to each of the output circuits $90_0$~$90_3$. Based on the number of repeat times k, one of the output circuits $90_0$~$90_3$ is selected and activated.

That is to say, when the count data signal Sq indicates the value "00", the output circuit $90_0$ is selected and activated. Then, as shown in FIG. 5, the output circuit $90_0$ converts the first to N-th output signals Sz1~Sz64 to the first to N-th scanning signals $OUT_1$~$OUT_{64}$, respectively. The first to N-th scanning signals $OUT_1$~$OUT_{64}$ are applied to the scan electrodes $Y_1$~$Y_{64}$ in order, respectively. When the count data signal Sq indicates the value "01", the output circuit $90_1$ is selected and activated. Then, the output circuit $90_1$ converts the first to N-th output signals Sz1~Sz64 to the first to N-th scanning signals $OUT_{65}$~$OUT_{128}$, respectively. The first to N-th scanning signals $OUT_{65}$~$OUT_{128}$ are applied to the scan electrodes $Y_{65}$~$Y_{128}$ in order, respectively. When the count data signal Sq indicates the value "10", the output circuit $90_2$ is selected and activated. Then, the output circuit $90_2$ converts the first to N-th output signals Sz1~Sz64 to the first to N-th scanning signals $OUT_{129}$~$OUT_{192}$, respectively. The first to N-th scanning signals $OUT_{129}$~$OUT_{192}$ are applied to the scan electrodes $Y_{129}$~$Y_{192}$ in order, respectively. When the count data signal Sq indicates the value "11", the output circuit $90_3$ is selected and activated. Then, the output circuit $90_3$ converts the first to N-th output signals Sz1~Sz64 to the first to N-th scanning signals $OUT_{193}$ $OUT_{256}$, respectively. The first to N-th scanning signals $OUT_{193}$~$OUT_{256}$ are applied to the scan electrodes $Y_{193}$~$Y_{256}$ in order, respectively.

Also, when the number of repeat times becomes 3, the counter 84 outputs the carry signal Sc to the AND circuit 86. Then, the AND circuit 86 receives the N-th output signal Se64 from the shift register 82. At this time, the AND circuit 86 outputs the initiation signal Sp to the driving circuit block 72. Also, the carry signal Sc is inputted to the AND circuit 83 through the inverter 85, which prohibits the transmission of the initiation signal Sg from the N-th flip-flop circuit $82_{64}$ to the first flip-flop circuit $82_1$. Thus, the shift register 82 of the driving circuit block 71 stops generating the output signals Se1~Se64.

The driving circuit block 72 receives the initiation signal Sp from the driving circuit block 71. In response to the initiation signal Sp, this driving circuit block 72 operates similarly to the driving circuit block 71. That is, the scanning signals $OUT_{257}$ to $OUT_{512}$ are applied to the scan electrodes $Y_{257}$ to $Y_{512}$, in order. After that, the timing controller 54 outputs the reset signal RES to reset the driving circuit blocks 71, 72. Then, the timing controller 54 outputs the initiation signal Sg to the driving circuit block 71, and the similar operation repeats.

As mentioned above, according to the present embodiment, the output signals Se1~Se64 are generated repeatedly by the one shift register 82 and converted to the output signals Sz1~Sz64 by the one output level shift circuit 87. Based on the number of repeat times, the output signals Sz1~Sz64 are repeatedly used as any of scanning signal groups $OUT_1$~$OUT_{64}$, $OUT_{65}$~$OUT_{128}$, $OUT_{129}$~$OUT_{192}$ and $OUT_{193}$~$OUT_{256}$. Thus, the one shift register 82 and the one output level shift circuit 87 are shared by the output circuits $90_0$~$90_3$. Therefore, the size of the scan electrode driving circuit 53 can be greatly reduced. Also, as shown in FIG. 7, the scanning signal generating circuit 80 is formed in the middle region $R_M$, and the output circuits $90_0$~$90_3$ are formed in the marginal region $R_N$. Therefore, the length of a short side of the rectangular chip 100 can be shortened. In other words, it is possible to make the peripheral unit smaller and hence to make the marginal area of the display apparatus narrower. In this case, the length of the short side of the rectangular chip 100 can be reduced by about 30 percent as compared with the conventional technique. Furthermore, the configuration of the scan electrode driving circuit 53 becomes less complex than that of the conventional one. Therefore, it is possible to reduce the cost and complexity for manufacturing this scan electrode driving circuit 53 and the display apparatus.

Second Embodiment

Figure 8:
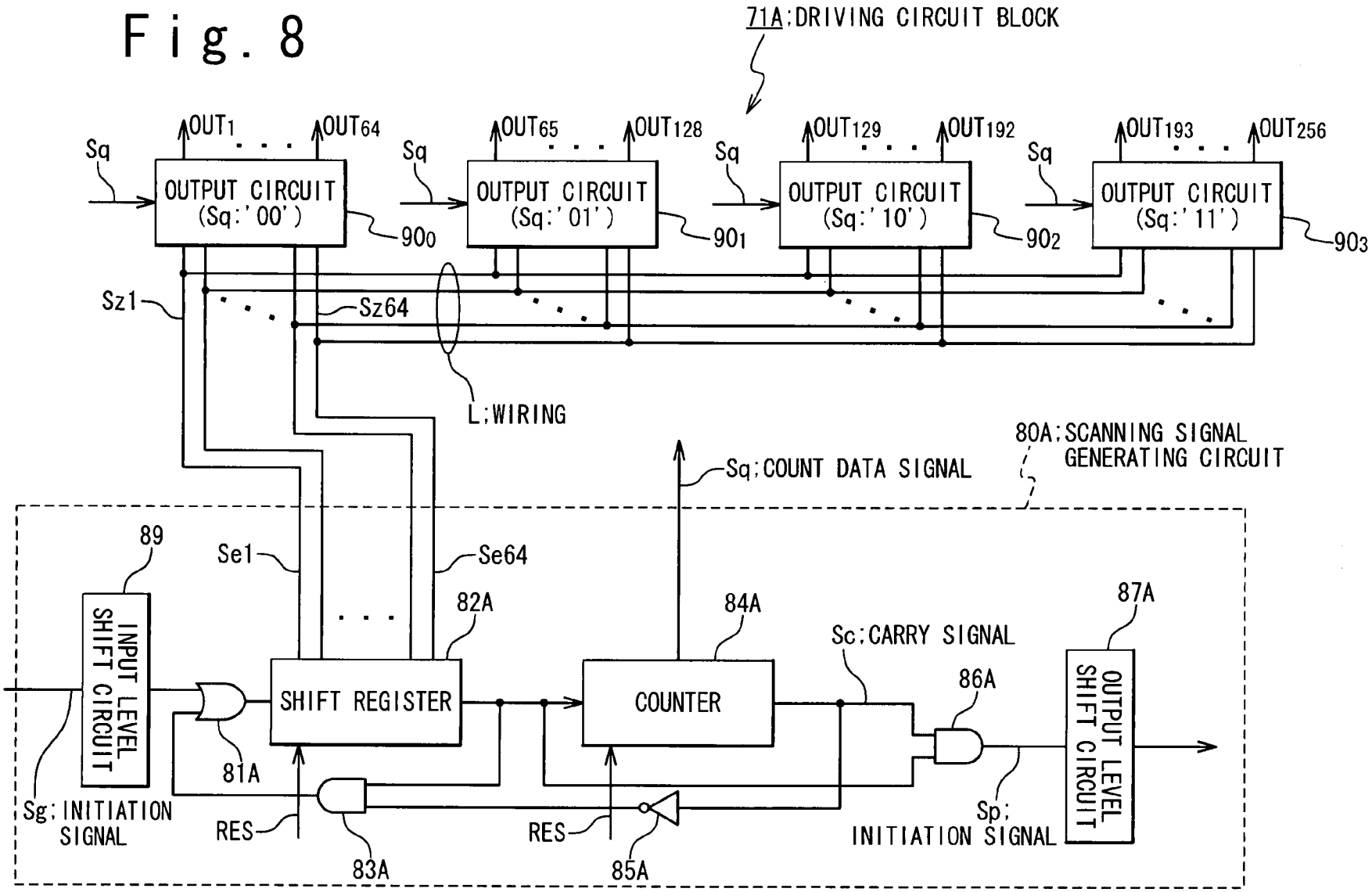
FIG. 8 is a circuit diagram showing a configuration of a driving circuit block of a display apparatus according to a second embodiment of the present invention.

FIG. 8 is a circuit diagram showing a configuration of a driving circuit block 71A of the display apparatus according to a second embodiment of the present invention.

The driving circuit block 71A has a scanning signal generating circuit 80A and M (M is an integer larger than 1) output circuits $90_0$~$90_{M-1}$. In the present embodiment, the integer M is set to 4, for example. The scanning signal generating circuit 80A includes an OR circuit 81A, a shift register 82A, an AND circuit 83A, a counter 84A, an inverter 85A, an AND circuit 86A, an output level shift circuit 87A and an input level shift circuit 89 level shift circuits 87, 88, as shown in FIG. 8. The shift register 82A includes N flip-flop circuits connected one after another. According to the present embodiment, the input level shift circuit 89 is connected to the shift register 82A through the OR circuit 81A. The shift register 82A is directly connected to the output circuits $\mathbf{90}_0$~$\mathbf{90}_3$. The counter 84A is also directly connected to the output circuits $\mathbf{90}_0$~$\mathbf{90}_3$. The output level shift circuit 87A is connected to the counter 84A through the AND circuit 86A. The connections among the shift register 82A, the counter 84A and the logic circuits 81A, 83A, 85A and 86A are the same as the connections among the shift register 82, the counter 84 and the logic circuits 81, 83, 85 and 86 in the first embodiment, and detailed explanations will be omitted here.

According to the present embodiment, the timing controller 54 outputs the initiation signal Sg to the input level shift circuit 89. The input level shift circuit 89 receives the initiation signal Sg, and converts voltage level of the initiation signal Sg from low voltage level to high voltage level. Then, the input level shift circuit 89 outputs the initiation signal Sg with high voltage level to the shift register 82A through the OR circuit 81A. Then, similar to the first embodiment, the shift register 82A repeatedly outputs a first to N-th output signals Se1~Se64 in order in synchronization with the clock signal CLK. Here, the output signals Se1~Se64 have high voltage level, and are directly inputted to the output circuits $\mathbf{90}_0$~$\mathbf{90}_3$. The counter 84A counts the number of repeat times and outputs a count data signal Sq. Here, the count data signal Sq has high voltage level, and is directly inputted to the output circuits $\mathbf{90}_0$~$\mathbf{90}_3$. Based on the number of repeat times, one of the output circuits $\mathbf{90}_0$~$\mathbf{90}_3$ is selected and activated. Thus, the scanning signals $OUT_1$~$OUT_{256}$ are applied to the scan electrodes $Y_1$~$Y_{256}$, respectively. After that, the AND circuit 86A outputs the initiation signal Sp with high voltage level to the output level shift circuit 87A. The output level shift circuit 87A converts the voltage level of the initiation signal Sp from high voltage level to low voltage level. Then, the output level shift circuit 87A outputs the initiation signal Sp with low voltage level to the driving circuit block 72.

Similar to the first embodiment, the scanning signal generating circuit 80A is formed in the middle region $R_M$ of a rectangular chip 100, the output circuits $\mathbf{90}_0$~$\mathbf{90}_3$ are formed in the marginal region $R_N$, the wirings L connecting the scanning signal generating circuit 80A and the output circuits $\mathbf{90}_0$~$\mathbf{90}_3$ are formed in the wiring regions $R_L$, as shown in FIG. 7.

According to the present embodiment, the output level shift circuit 87A and the input level shift circuit 89 are provided instead of the output level shift circuits 87, 88. Moreover, the OR circuit 81A, the shift register 82A, the AND circuit 83A, the counter 84A, the inverter 85A and the AND circuit 86A are formed by using transistors for high voltage level. Thus, it is not necessary to use both transistors for high voltage level and transistors for low voltage level. Therefore, it becomes further easier to manufacture the scan electrode driving circuit 53 and the LCD apparatus according to the present embodiment, which is the effect achieved in addition to the effects in the first embodiment. It should be noted that in the present embodiment the length of the short side of the rectangular chip 100 can be reduced by about 50 percent as compared with the conventional technique.

The present invention can be generally applied not only to the LCD apparatus but also to a display apparatus in which scan electrodes are scanned in order, such as a plasma display apparatus and an EL (Electro Luminescence) display apparatus and the like. Moreover, the number of the plurality of output circuits 90 is not limited to 4, and more output circuits can be added. In this case, the counter 84 outputs a multi-bit signal (3-bit signal, 4-bit signal and so on) as the count data signal to the plurality of output circuits 90. Furthermore, the present invention can be applied to a case in which a plurality of scan electrodes are driven at the same time. In this case, logic circuits for driving the plurality of scan electrodes at the same time are added to the output of the shift register 82.

It will be obvious to one skilled in the art that the present invention may be practiced in other embodiments that depart from the above-described specific details. The scope of the present invention, therefore, should be determined by the following claims.

What is claimed is:

1. A scan electrode driving circuit, which supplies a scanning signal to each of a plurality of scan electrodes of a display panel, comprising:

a scanning signal generating circuit; and

M (M is an integer larger than 1) output circuits connected to said scanning signal generating circuit, wherein said scanning signal generating circuit generates a first to N-th (N is an integer larger than 1) output signals in order, and outputs each of said first to N-th output signals repeatedly to each of said M output circuits, wherein said scanning signal generating circuit counts a number of repeat times, and outputs a count data signal indicative of said number of repeat times to each of said M output circuits, wherein, when said count data signal indicates a value k (k is an integer in a range from 0 to M- 1), k-th output circuit of said M output circuits converts said first to N-th output signals to a first to N-th scanning signals, respectively, and outputs said first to N-th scanning signals to N scan electrodes of said plurality of scan electrodes in order, respectively.

2. The scan electrode driving circuit according to claim 1, wherein said scanning signal generating circuit comprises:

a shift register including a first to N-th flip-flop circuits which are connected one after another; and a counter connected to said shift register, wherein an output of said N-th flip-flop circuit is connected to said counter and an input of said first flip-flop circuit, wherein an initiation signal inputted to said first flip-flop circuit is shifted from said first flip-flop circuit to said N-th flip-flop circuit in synchronization with a clock signal, wherein said first to N-th flip-flop circuits output said first to N-th output signals to said each output circuit in response to said initiation signal, respectively, wherein said counter counts a number of said N-th output signals outputted from said N-th flip-flop circuit as said number of repeat times, and outputs said count data signal to said each output circuit.

3. The scan electrode driving circuit according to claim 2, wherein each of said M output circuits comprises:

a decoder receiving said count data signal; and a first to N-th output buffers connected to said first to N-th flip-flop circuits, respectively, wherein said decoder of said k-th output circuit generates an activation signal which activates said first to N-th output buffers, when said count data signal indicates said value k, wherein, if activated, said first to N-th output buffers convert said first to N-th output signals to said first to N-th scanning signals, respectively, and output said first to N-th scanning signals to said N scan electrodes, respectively.

4. The scan electrode driving circuit according to claim 1, wherein said scanning signal generating circuit is formed in a middle of a rectangular chip, wherein said M output circuits are formed along a long side of said rectangular chip.

5. A scan electrode driving circuit, which supplies a scanning signal to each of a plurality of scan electrodes of a display panel, comprising a plurality of driving circuit blocks connected one after another, wherein each of said plurality of driving circuit blocks comprises:

a scanning signal generating circuit; and

M (M is an integer larger than 1) output circuits connected to said scanning signal generating circuit, wherein said scanning signal generating circuit generates a first to N-th (N is an integer larger than 1) output signals in order, and outputs each of said first to N-th output signals repeatedly to each of said M output circuits, wherein said scanning signal generating circuit counts a number of repeat times, and outputs a count data signal indicative of said number of repeat times to each of said M output circuits, wherein, when said count data signal indicates a value k (k is an integer in a range from 0 to M-1), k-th output circuit of said M output circuits converts said first to N-th output signals to a first to N-th scanning signals, respectively, and outputs said first to N-th scanning signals to N scan electrodes of said plurality of scan electrodes in order, respectively.

6. The scan electrode driving circuit according to claim 5, wherein said scanning signal generating circuit comprises:

a shift register including a first to N-th flip-flop circuits which are connected one after another; and a counter connected to said shift register, wherein an output of said N-th flip-flop circuit is connected to said counter and an input of said first flip-flop circuit, wherein an initiation signal inputted to said first flip-flop circuit is shifted from said first flip-flop circuit to said N-th flip-flop circuit in synchronization with a clock signal, wherein said first to N-th flip-flop circuits output said first to N-th output signals to said each output circuit in response to said initiation signal, respectively, wherein said counter counts a number of said N-th output signals outputted from said N-th flip-flop circuit as said number of repeat times, and outputs said count data signal to said each output circuit.

7. The scan electrode driving circuit according to claim 6, wherein each of said M output circuits comprises:

a decoder receiving said count data signal; and a first to N-th output buffers connected to said first to N-th flip-flop circuits, respectively, wherein said decoder of said k-th output circuit generates an activation signal which activates said first to N-th output buffers, when said count data signal indicates said value k, wherein, if activated, said first to N-th output buffers convert said first to N-th output signals to said first to N-th scanning signals, respectively, and output said first to N-th scanning signals to said N scan electrodes, respectively.

8. The scan electrode driving circuit according to claim 6, wherein said scanning signal generating circuit further comprises a logic circuit connected to said shift register and said counter, wherein said counter outputs a carry signal to said logic circuit when said number of repeat times becomes M- 1, wherein, when receiving said carry signal from said counter and said N-th output signal from said N-th flip-flop circuit, said logic circuit prohibits transmission of said initiation signal from said N-th flip-flop circuit to said first flip-flop circuit, and outputs another initiation signal to another of said plurality of driving circuit blocks.

9. The scan electrode driving circuit according to claim 8, wherein said scanning signal generating circuit further comprises:

a first level shift circuit connected to said shift register; and a second level shift circuit connected to said logic circuit, wherein said first level shift circuit receives said initiation signal, and outputs said initiation signal to said first flip-flop circuit after converting voltage level from low level to high level, wherein said second level shift circuit receives said another initiation signal from said logic circuit, and outputs said another initiation signal to said another driving circuit block after converting voltage level from high level to low level.

10. The scan electrode driving circuit according to claim 6, wherein said scanning signal generating circuit further comprises:

a first level shift circuit connected to said shift register and said M output circuits; and a second level shift circuit connected to said counter and said M output circuits, wherein said first level shift circuit receives said first to N-th output signals from said shift register, and outputs said first to N-th output signals to said M output circuits after converting voltage level from low level to high level, wherein said second level shift circuit receives said count data signal from said counter, and outputs said count data signal after converting voltage level from low level to high level.

11. The scan electrode driving circuit according to claim 5, wherein said scanning signal generating circuit is formed in a middle of a rectangular chip, wherein said M output circuits are formed along a long side of said rectangular chip.

12. A display apparatus comprising:

a display panel having a plurality of scan electrodes; and a scan electrode driving circuit configured for supplying scanning signals to said plurality of scan electrodes, said scan electrode driving circuit comprising:

a scanning signal generating circuit; and

M (M is an integer larger than 1) output circuits connected to said scanning signal generating circuit, wherein said scanning signal generating circuit generates a first to N-th (N is an integer larger than 1) output signals in order, and outputs each of said first to N-th output signals repeatedly to each of said M output circuits, wherein said scanning signal generating circuit counts a number of repeat times, and outputs a count data signal indicative of said number of repeat times to each of said M output circuits, wherein, when said count data signal indicates a value k (k is an integer in a range from 0 to M- 1), k-th output circuit of said M output circuits converts said first to N-th output signals to a first to N-th scanning signals, respectively, and outputs said first to N-th scanning signals to N scan electrodes of said plurality of scan electrodes in order, respectively.

13. A display apparatus comprising:

a display panel having a plurality of scan electrodes; and a scan electrode driving circuit configured for supplying scanning signals to said plurality of scan electrodes, said scan electrode driving circuit comprising a plurality of driving circuit blocks connected one after another, wherein each of said plurality of driving circuit blocks comprises:

a scanning signal generating circuit; and M (M is an integer larger than 1) output circuits connected to said scanning signal generating circuit, wherein said scanning signal generating circuit generates a first to N-th (N is an integer larger than 1) output signals in order, and outputs each of said first to N-th output signals repeatedly to each of said M output circuits, wherein said scanning signal generating circuit counts a number of repeat times, and outputs a count data signal indicative of said number of repeat times to each of said M output circuits, wherein, when said count data signal indicates a value k (k is an integer in a range from 0 to M-1), k-th output circuit of said M output circuits converts said first to N-th output signals to a first to N-th scanning signals, respectively, and outputs said first to N-th scanning signals to N scan electrodes of said plurality of scan electrodes in order, respectively.

14. The display apparatus according to claim 12, wherein said display panel is a liquid crystal display panel.

* * * * *